US006523739B2

(12) United States Patent
Heeley et al.

(10) Patent No.: US 6,523,739 B2
(45) Date of Patent: Feb. 25, 2003

(54) CARTON FOR FOOD PRODUCTS AND CARTON BLANK FOR SUCH A CARTON

(75) Inventors: John Heeley, Munich (DE); Alain Kowalewski, Strasbourg (FR); Luigi Tettamanti, Como (IT)

(73) Assignee: Kraft Foods R&D Inc., Munich (DE)

( * ) Notice: Subject to any disclaimer, the term of this patent is extended or adjusted under 35 U.S.C. 154(b) by 0 days.

(21) Appl. No.: 09/804,914

(22) Filed: Mar. 13, 2001

(65) Prior Publication Data

US 2002/0014522 A1 Feb. 7, 2002

(30) Foreign Application Priority Data

Mar. 13, 2000 (EP) ..... 00104554

(51) Int. Cl.[7] ..... B65D 17/28

(52) U.S. Cl. ..... 229/109; 229/237; 229/243; 229/902

(58) Field of Search ..... 229/109, 120.09, 229/121, 237, 243, 902, 906; 206/427, 435

(56) References Cited

U.S. PATENT DOCUMENTS

| | | | | |
|---|---|---|---|---|
| 3,002,613 A | * | 11/1961 | Merkel et al. | 229/120.09 |
| 3,309,005 A | * | 3/1967 | Pilger | 229/906 |
| 3,355,089 A | * | 11/1967 | Champlin | 229/243 |
| 3,512,697 A | * | 5/1970 | Robinson | 229/902 |
| 3,923,234 A | * | 12/1975 | Lund, Jr. | 229/109 |
| 4,109,849 A | * | 8/1978 | Wood | 229/121 |
| 4,222,485 A | | 9/1980 | Focke | 206/141 |
| 4,256,226 A | * | 3/1981 | Stone | 206/427 |
| 4,375,258 A | * | 3/1983 | Crayne et al. | 229/121 |
| 5,605,279 A | * | 2/1997 | Adamek | 229/906 |

FOREIGN PATENT DOCUMENTS

| | | |
|---|---|---|
| DE | 76 32 223 U | 2/1977 |
| EP | 0 997 380 A1 | 5/2000 |
| FR | 2 683 207 A1 | 5/1993 |

OTHER PUBLICATIONS

European Search Report, for European Patent Application No. 00104554.1–1261, 1 page; Annex to the European Search Report, 1 page; and cover sheet, dated Aug. 28, 2000.

* cited by examiner

*Primary Examiner*—Gary E. Elkins
(74) *Attorney, Agent, or Firm*—Fitch, Even, Tabin & Flannery

(57) ABSTRACT

A carton for food products comprising a bottom, a top and four side faces. This carton is such that at least a portion of each of two first opposite side faces is foldable about a generally horizontal fold line and is movable with regard to second opposite side faces or a remainder of the first side faces or can be separated therefrom. In addition, two dividing lines are formed on at least a top face defining, on one hand, two outer wall portions, which are foldable in connection with foldable portions of the first opposite side faces and, on an other hand, an inner wall portion between the two dividing lines, constituting a handle when the outer wall portions are separated along the dividing lines and folded outwards. The first side faces comprise beveled wall portions in lateral regions of the first side faces. Furthermore, a carton blank for a carton for food products comprising a top face portion, two first side face portions, two second side face portions, and a bottom face portion is provided. This carton blank is such that at least a portion of each of two first opposite side face portions is foldable about a generally horizontal fold line, two dividing lines are formed on at least the top face portion defining, on the one hand, two outer wall portions which are foldable in connection with the foldable portions of the first side face portions and, on the other hand, an inner wall portion between them.

3 Claims, 2 Drawing Sheets

CARTON FOR FOOD PRODUCTS AND CARTON BLANK FOR SUCH A CARTON

TECHNICAL FIELD

The present invention relates to a carton for food products and a blank for such a carton.

In particular in the field of the food industry, various requirements are to be met by cartons in which a plurality of products, for example chocolate or confectionery products, are to be packaged. On the one hand, the products, which are of comparably small size, must be housed safely in a suitable package, for example a carton. On the other hand, when one or more of the food products is to be consumed, it is desirable to use a carton which can not only be opened easily, but which also provides easy access to the food products contained therein. In some cases, the carton should furthermore be reclosable.

BACKGROUND ART

Numerous cartons for accommodating a plurality of food products are known in the art and available on the market. Some of the known cartons present a side face, which can be opened so as to allow the removal of one or more of the food products contained in the carton. Other cartons comprise lids formed by their top face which can be separated from the remainder of the carton so that an opening is formed.

SUMMARY OF THE INVENTION

In view of the known cartons for accommodating a plurality of food products, it is an object underlying the invention to provide a carton that can be opened easily and allows presentation of the food products contained therein in a novel, advantageous manner. Furthermore, a carton blank for the manufacture of such a carton is to be provided.

This object is solved by the carton according to the claims.

In accordance with the invention, the carton generally comprises a bottom, a top, and four side faces. On each of two first, opposite side faces at least a portion thereof is foldable about a generally horizontal fold line. It is to be understood that the first side faces can, as a whole, be foldable about such a horizontal fold line. In particular, this fold line can be formed at the edge between each of the first side faces and the bottom face. In order to allow easy folding of the entire first side faces (or portions thereof) in an outward direction, the foldable portions-or the side faces as such-are loose with regard to the other, second opposite side faces. If each of the first side faces is entirely foldable in an outward direction, the first side faces must be loose with regard to the second side faces. However, if merely certain portions of each of the first side faces are formed foldable, these portions must be arranged loosely with regard to the remainder of the first side faces, or separable therefrom. Naturally, each of the first side faces in its entirety can also be formed separable from the second side faces if it is desired to allow outward folding of the entire first side faces.

On at least the top face two dividing lines are formed, which on the one hand define two outer wall portions, said outer wall portions being foldable in connection with the foldable portion of the first side faces. In other words, the described outer wall portions of the top face cooperate with the first side faces or portions thereof in generating a largely (in a sectional view) L-shaped flap. Such a flap is formed between each of the dividing lines formed on the top face and the respective first side face. After breaking the dividing lines in order to open the inventive carton, these flaps can be folded outwards so as to present a comparably large opening of the inventive carton at the top face thereof. After opening and outwardly folding the flaps, the outwardly folded flaps will also accommodate the food products so as to provide a large area in which the food products contained in the carton can be dispersed.

Finally, the dividing lines formed on the top face of the inventive carton define an inner wall portion, which is located between the dividing lines and which forms a handle when the dividing lines are broken and the resulting flaps are folded outwards. In particular, the handle formed between the dividing lines of the top face can be seen as the handle of a basket, which is formed by the inventive carton when the dividing lines are broken and the flaps are folded outwards so as to present the contents of the carton to the consumer. The so-called sharing basket formed by the inventive carton constitutes in its opened state a nice and novel way to display food products such as sugar and chocolate confectionery, and it enables a number of consumers to take the food products from the so-called basket. At the same time, as long as the carton is closed and the dividing lines formed on the top face of the carton are not broken, the invention provides a carton which enables safe shipping and handling of a number of food products.

Preferred embodiments of the inventive carton are described in the dependent claims.

The dividing lines formed on the top face can extend across only a portion of the top face, but could also extend over a portion of the second side faces so that a portion of the second side faces can also be folded outwards together with the so-called outer wall portions of the top face. However, it is currently preferred to form the dividing lines such that they extend across the top face and at the edges between the top face and the second side faces. In other words, the outer wall portions of the top face, which can be folded outwards together with the first side faces, extend all across the top face. Accordingly, the remaining strip forming the handle of the resulting basket will also extend over the entire top face.

With regard to design aspects, it has been found advantageous to form the dividing lines such that they extend across the top face in a zigzag manner. In particular, the zigzag pattern has been found advantageous to correspond to the design of the top face, for example by delimiting portions which are colored differently from each other. Furthermore, a zigzag pattern of the dividing lines may help the consumer to find the dividing lines when the inventive carton is to be opened.

Preferably the first side faces comprise beveled wall portions in their lateral regions. In other words, the first side faces are formed so as to extend in a beveled way towards the second side faces. In this way, the basket, which is constituted by the open carton, can accommodate numerous food products in a very reliable manner. This is due to the fact that the beveled portions of the first side faces will extend in an upward direction from the first side faces, when these are folded outwards. Thus, the beveled wall portions form upwardly sloping side walls, and the outwardly folded first side faces are a part of the bottom of the basket. In other words, in the opened state of the inventive carton, when the so-called sharing basket is formed, the food products contained in the basket are kept within the basket by the cooperation of the second side faces, the beveled portions of the first side faces, as well as the so-called outer portions of the top face of the carton, which are folded outwards so as to form side walls.

With regard to the connection between the above-described beveled wall portions and the bottom and the top faces of the inventive carton, it has been found advantageous to form two fold lines (these being foldable in opposite directions) and a generally triangle shaped wall portion between the beveled wall portion and the bottom as well as the top face. In this manner, easy unfolding of the first side faces including their beveled wall portions in order to form the so-called basket is achieved.

In this case, it is further preferred that the described triangle shaped wall portions are bonded to the top face of the inventive carton, whereas they are loose with regard to the bottom face. As mentioned, this configuration allows easy unfolding of the first side faces with regard to the second side faces as well as the bottom face, whereas the beveled wall portions are safely bonded to the outer wall portions of the top face so as to form side wall portions of the so-called basket, said side wall portions reliably keeping the food products within the basket.

The abovedescribed object underlying the invention is, on the other hand, solved by a carton blank as described in the claims.

In a manner corresponding to the carton, which is to be manufactured from the carton blank, the inventive carton blank comprises a top face portion, two first side face portions, two second side face portions, and a bottom face portion. Furthermore, at least a portion of each of the first side face portions is foldable about a fold line, which is usually arranged horizontally on the completed carton. Two dividing lines are formed on at least the top face portion so as to define, on the one hand, two outer wall portions connected with the foldable portions of the first side face portions, and, on the other hand, an inner wall portion between the dividing lines which will constitute a handle formed on the open carton so that a basket is formed.

Preferred embodiments of the inventive carton blank are defined in the further claims.

In line with the preferred embodiment of the inventive carton, it is preferred that the dividing lines extend across the top face portion and at the edges between the top face portion and the second side face portions.

In order to enable the manufacture of a carton with a nice outer appearance, it is preferred to form the dividing line in a zigzag manner on the top face portion.

In order to form beveled wall portions on the first side faces of the completed carton, it is preferred with regard to the carton blank to form wall portions of the first side face portions, which are foldable about fold lines running perpendicular to the lines between the first side face portions and the bottom and top face portions.

For a proper unfolding of the completed carton, it has been found advantageous to form triangle shaped wall portions between the lateral, foldable portions of the first side face portions and the bottom face portion. The triangle shaped wall portions are delimited by fold lines, which are foldable in opposite directions. With this construction, the inventive carton can be formed to permit easy unfolding so as to form the so-called basket and simultaneously connect the first side faces with the outer wall portions of the top face, such that the food products are reliably kept inside the basket.

BRIEF DESCRIPTION OF THE DRAWINGS

Further advantages and features of the present invention will become apparent from the following description of a preferred embodiment thereof, which is to be taken with reference to the accompanying drawings, in which.

DETAILED DESCRIPTION OF THE PREFERRED EMBODIMENT OF THE INVENTION

Figure 1:
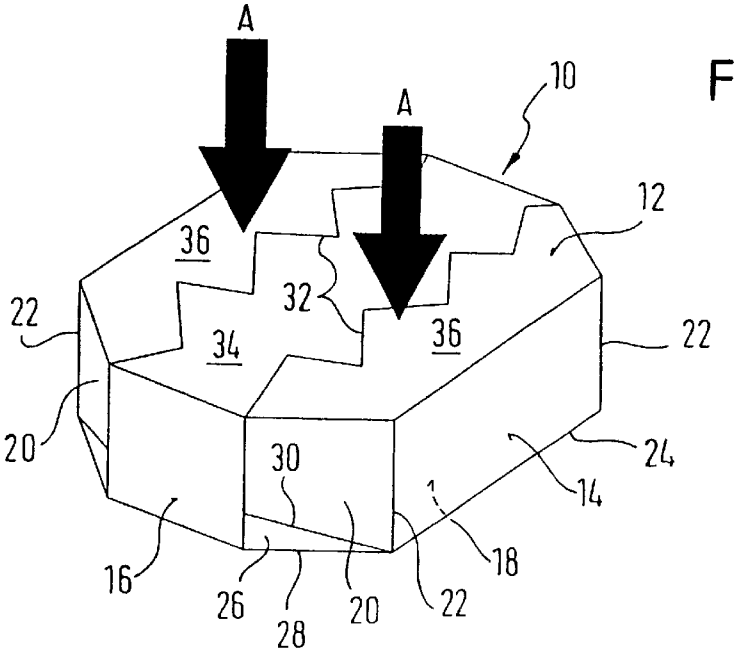
FIG. 1 shows a perspective view of the inventive carton.

As can be taken from FIG. 1, the inventive carton comprises a top face 12, two first side faces 14 (of which only the one located at the front can be seen in FIG. 1), two second side faces 16 (of which only the one located at the front can be seen in FIG. 1), and a bottom face 18. The first side faces 14 comprise beveled wall portions 20 in their lateral regions. These beveled wall portions 20 are formed by, on the one hand, folding the beveled wall portions 20 about folding lines 22 extending in a general vertical direction on the complete carton, which corresponds to a direction perpendicular to the edge 24 between the first side faces 14 and the bottom face 18. Furthermore, the beveled wall portions 20 are connected with the bottom face 18 by means of a triangle shaped wall portion 26, which is delimited by two fold lines 28, 30, which are foldable in different directions. In particular, the triangle shaped wall portion 26 is folded inwards, in other words onto the bottom face 18 by means of the fold line 28. At the fold line 30, the beveled wall portion 20 is folded outwards with regard to the triangle shaped wall portion 26, so as to stand upright on the completed carton.

It should be noted here that the connection between the beveled wall portions 20 and the top face 12 is formed in the same manner, with the exception that the triangle shaped wall portions 26 are in this case bonded to the top face 12. In contrast, the triangle shaped wall portions 26 located on the bottom face 18 are not bonded thereto, so that the inventive carton can easily be unfolded to form a basket, as will be described later. To enable this unfolding, the beveled wall portions 20 must be separable from the second side faces 16 with which the beveled wall portions 20 are in contact inside the carton. Preferably, the beveled wall portions 20 are even loose with regard to the second side faces 16. Also with this configuration, the contents of the inventive carton 10 can be reliably kept within the carton by means of the various faces 12, 14, 16, 18, which are generally closed.

In order to allow opening of the inventive carton 10, two dividing lines 32 are formed on the top face 12. Preferably the dividing lines 32 are formed as perforation lines. The dividing lines 32, on the one hand, delimit a strip-like inner wall portion 34 of the top face 12. In the depicted case, the dividing lines 32 have a zigzag shape. On the other hand, outer wall portions 36 are defined between the dividing lines 32 and the first side faces 14. With this configuration, the inventive carton 10 can be opened by applying pressure (for example, by means of the thumbs of both hands) in the direction of the arrows A onto the dividing lines 32. In this way, the dividing lines 32 are broken so that the outer wall portions 36 can be folded outwards together with the first side faces 14.

Figure 2:
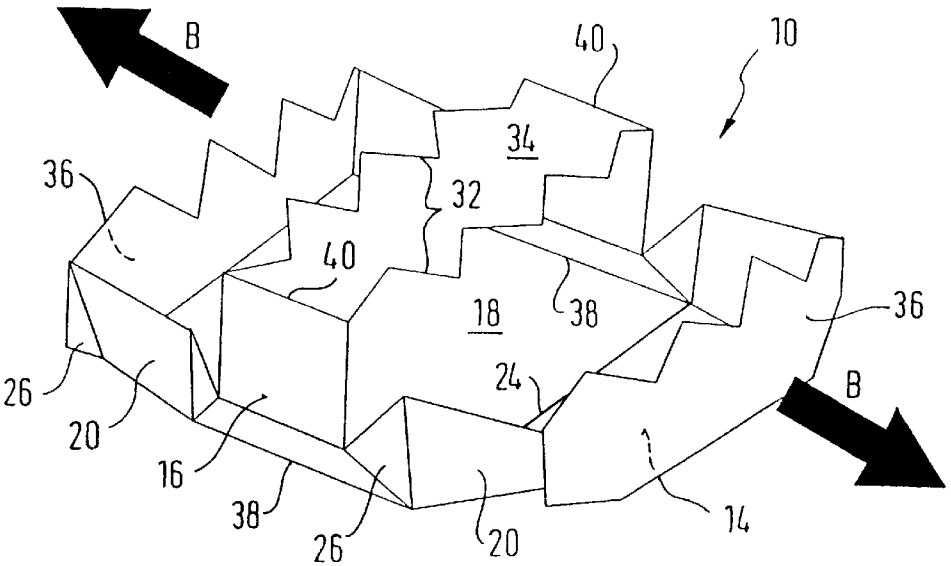
FIG. 2 shows a perspective view of the inventive carton in its opened state forming the "sharing basket"

In FIG. 2, the opened state of the inventive carton 10 is shown. As mentioned above, the first side faces 14 are foldable about the edges 24 together with the outer wall portions 36 of the top face 12, which are arranged adjacent to the first side faces 14. Due to the unfolding movement, which is effected by pulling the mentioned portions in the direction of the arrows B, the first side faces 14 of the carton are arranged so as to form a part of the bottom of the resulting basket. Furthermore, the outer wall portions 36 of the top face 12 constitute side walls. As was described above with reference to FIG. 1, the beveled wall portions 20 are coupled with the remainder of the first side faces 14 such that they extend in an upwardly inclining manner from the first side faces 14 of the basket shown in FIG. 2. Consequently, the beveled wall portions 20 will assist in keeping the contents of the basket inside the basket. In this context, it can be taken from FIG. 2 that the triangle shaped wall portions 26 have also been unfolded so that they will now extend between the somewhat erected beveled wall portions 20 and a lateral portion of the bottom face 18 so as to support the formation of the side walls keeping the contents within the basket. As can, for example, be taken from the left corner of the rear first side face 14 according to FIG. 2, the beveled wall portion 20 has not been unfolded from this outer wall portion 36, because the adjacent triangle shaped wall portion 26 is bonded to the outer wall portion 36. Therefore the outer wall portion 36 will extend generally vertically and keep the contents in the basket.

As can clearly be taken from FIG. 2, the inner wall portion 34 defined between the dividing lines 32 constitutes a handle of the basket resulting from the inventive carton. The generation of the basket is aided in the depicted embodiment by means of fold lines 38 which are formed in the bottom face 18 extending between the opposite first side faces 14. In this way, when the basket is lifted by means of gripping the handle 34, the bottom face 18 will deform somewhat at least along the fold lines 38 so as to form a bowl accommodating the contents of the basket. The fold lines could also extend at a position closer to the center of the bottom of the bottom face 18, corresponding to a wider shape of the beveled wall portions 20.

It should be noted that the dividing lines 32 do not necessarily have to be arranged at a distance apart from each other which corresponds to the width of the second side faces 16, as shown in the Figures. Rather, the dividing lines 32 can be arranged closer together so that they are additionally formed at the edges 40 located between the top face 12 and the second side faces 16. In this way, the outer wall portions 36 are additionally separated from the second side faces 16 along a portion of the edges 40. Consequently, the handle 34 will be formed somewhat narrower, and the outer wall portions 36 will be wider (or higher according to the orientation at the basket shown in FIG. 2). However, the general appearance and function will remain the same.

Figure 3:
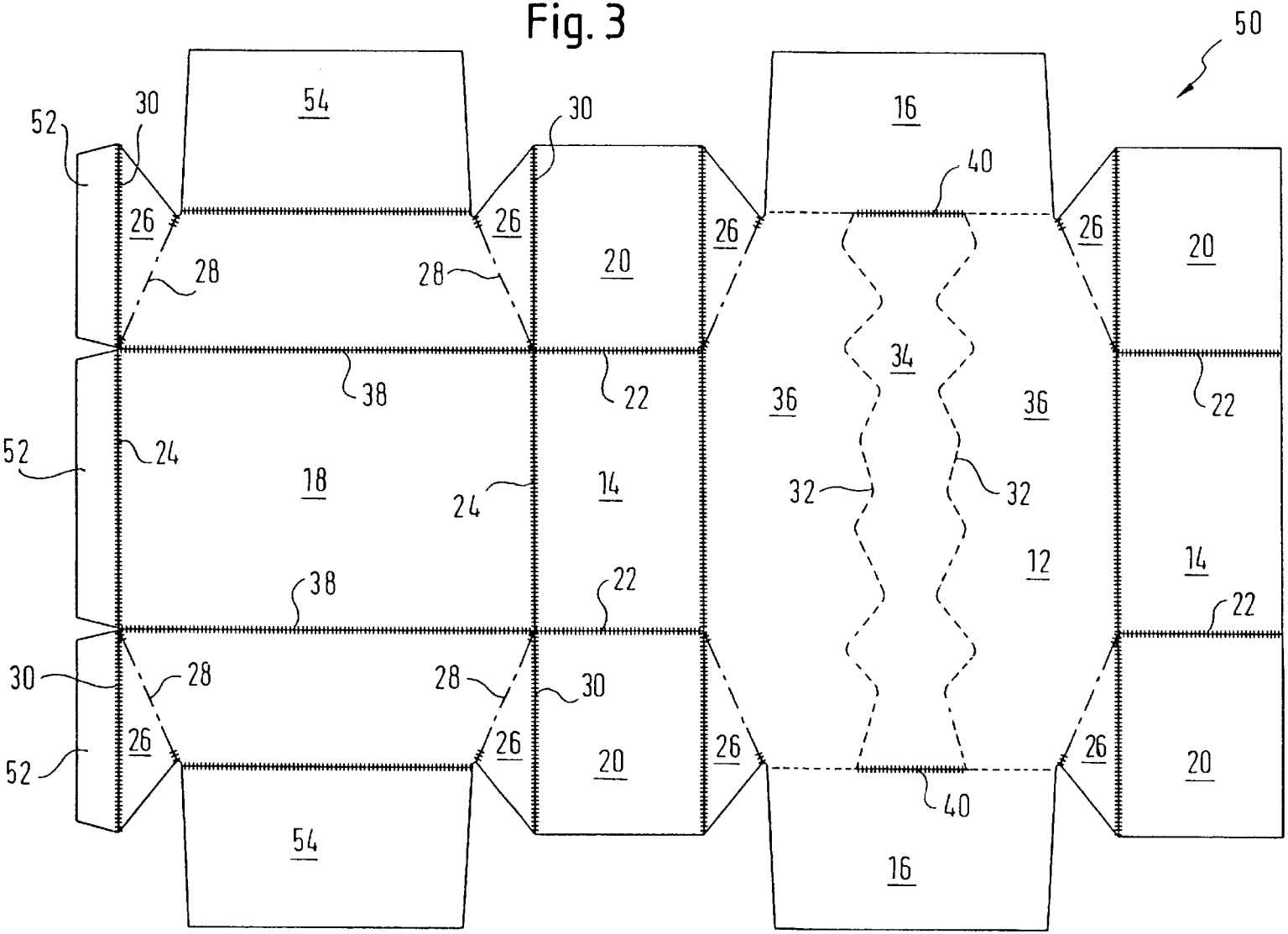
FIG. 3 shows a plan view of the carton blank according to the present invention.

The carton blank, which is shown in FIG. 3, is modified in the above-described manner. As can be taken from the drawing, the dividing lines 32 formed on the top face portion of the carton blank delimit a strip-like inner wall portion 34 which does not extend over the entire width of the top face portion 12. Correspondingly, a fold line is merely formed in that portion of the edge 40 between the top face portion 12 and the second side face portions 16, which is located between the dividing lines 32. At both sides of this fold line the dividing lines 32 continue between the outer wall portions 36 of the top face portion 12 and the second side face portions 16. For forming the basket in accordance with the procedure shown in FIGS. 1 and 2, the dividing lines 32 are additionally separated in the mentioned portions located at the edge between the outer wall portions 36 and the second side face portions 16 so as to allow the outer wall portions to be folded outwards together with the first side faces 14.

Another difference between the carton shown in FIGS. 1 and 2 and the carton which can be made from the carton blank 50 shown in FIG. 3 is represented by the configuration of the first side faces 14. As can be taken from FIG. 3, those portions of the first side faces 14, which are not beveled towards the second side faces 16 are remarkably narrower than the corresponding portions of the carton shown in FIG. 1. This can also be verified by means of the fold lines 28 formed between the bottom face 18 and the triangle shaped wall portions 26. As can be taken from the plan view of FIG. 3, these fold lines 28 form an obtuse angle with the fold line 24, which is remarkably larger than the corresponding angle of the carton according to FIG. 1.

In accordance with the described modification, the fold lines 38 formed in the bottom face 18 are located farther from the second side faces 16. This causes a shape of the basket (which is formed after the opening of the carton) which is even more bowl-like, because larger wall portions between the fold lines 38 and the edges of the bottom face 18 are folded upwards when the basket is held at the handle formed by the strip-like inner wall portion 34.

As can easily be taken from the drawing of FIG. 3, the final carton is made from the shown carton blank 50 by folding the various fold lines and gluing those triangle shaped wall portions 26, which are adjacent to the top face 12, to the inside of the top face 12. Furthermore, those flaps 52 which are formed at the "free end" of the bottom face portion 18 and the adjacent triangle shaped wall portions 26 are bonded to the free end of the first side face portions 14 and the beveled wall portions 20 thereof. Finally, flaps 54 formed adjacent to the bottom face portion 18 are bonded to the inside of the second side face portions 16. The above-mentioned steps may also be performed in a different order.

We claim:

1. A carton for food products comprising a bottom, a top and four side faces wherein at least a portion of each of two first opposite side faces is foldable about a generally horizontal fold line and is movable with regard to second opposite side faces or a remainder of the first side faces or can be separated therefrom, two dividing lines are formed on at least a top face defining, on one hand, two outer wall portions, which are foldable in connection with foldable portions of the first opposite side faces and, on an other hand, an inner wall portion between the two dividing lines, constituting a handle when the outer wall portions are separated along the dividing lines and folded outwards, the first side faces comprise beveled wall portions in lateral regions of the first side faces, and the beveled wall portions are each connected with the bottom face and the top face via two fold lines foldable in opposite directions and a generally triangle-shaped wall portion between the beveled wall portion and the bottom face and the top face, respectively.

2. A carton according to claim 1, wherein, the triangle shaped wall portion is bonded to the top face, and wherein it is moveable with regard to the bottom face.

3. A carton blank for a carton for food products comprising a top face portion, two first side face portions, two second side face portions, and a bottom face portion, wherein at least a portion of each of two first opposite side face portions is foldable about a generally horizontal fold line, two dividing lines are formed on at least the top face portion defining, on the one hand, two outer wall portions which are foldable in connection with the foldable portions of the first side portions and, on the other hand, an inner wall portion between them, and triangle-shaped wall portions are delimited by two fold lines foldable in opposite directions and are formed between the foldable wall portions and the bottom face portion and the top face portion respectively.

* * * * *

UNITED STATES PATENT AND TRADEMARK OFFICE

CERTIFICATE OF CORRECTION

PATENT NO. : 6,523,739 B2
DATED : February 25, 2003
INVENTOR(S) : Heeley et al.

It is certified that error appears in the above-identified patent and that said Letters Patent is hereby corrected as shown below:

Column 8,
Line 16, after "side", insert -- face --.

Signed and Sealed this

Nineteenth Day of August, 2003

JAMES E. ROGAN
*Director of the United States Patent and Trademark Office*